US009815185B2

(12) United States Patent
Machida

(10) Patent No.: US 9,815,185 B2
(45) Date of Patent: Nov. 14, 2017

(54) POWER TOOL

(71) Applicant: MAKITA CORPORATION, Anjo-shi, Aichi (JP)

(72) Inventor: Yoshitaka Machida, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 405 days.

(21) Appl. No.: 14/554,890

(22) Filed: Nov. 26, 2014

(65) Prior Publication Data

US 2015/0144366 A1 May 28, 2015

(30) Foreign Application Priority Data

Nov. 26, 2013 (JP) ..... 2013-244446

(51) Int. Cl.

| | |
|---|---|
| ***B25F 5/02*** | (2006.01) |
| ***B25D 17/24*** | (2006.01) |
| ***B25D 17/04*** | (2006.01) |
| ***B25F 5/00*** | (2006.01) |
| ***B25D 16/00*** | (2006.01) |

(52) U.S. Cl.

CPC ..... *B25D 17/043* (2013.01); *B25D 16/00* (2013.01); *B25D 17/24* (2013.01); *B25F 5/006* (2013.01); *B25D 2211/061* (2013.01)

(58) Field of Classification Search

CPC ..... B25F 5/02; B25D 17/24
USPC ..... 173/162.2
See application file for complete search history.

(56) References Cited

U.S. PATENT DOCUMENTS

| | | | | |
|---|---|---|---|---|
| 9,434,062 | B2 * | 9/2016 | Kamegai | B25D 17/24 |
| 2003/0037937 | A1 | 2/2003 | Frauhammer et al. | |
| 2009/0266571 | A1 | 10/2009 | Baumann et al. | |
| 2011/0011608 | A1 | 1/2011 | Saur | |
| 2012/0160533 | A1 * | 6/2012 | Kamegai | B25D 17/24 173/162.2 |
| 2015/0041170 | A1 | 2/2015 | Yoshikane et al. | |

FOREIGN PATENT DOCUMENTS

| | | | |
|---|---|---|---|
| EP | 2444206 | A1 | 4/2012 |
| JP | 2009-509790 | A | 3/2009 |
| JP | 2011-000684 | A | 1/2011 |
| JP | 2013-151055 | A | 8/2013 |
| WO | 02/06015 | A1 | 1/2002 |

(Continued)

OTHER PUBLICATIONS

Mar. 26, 2015 Exteneded Search Report issued in European Patent Application No. 14194519.6.

(Continued)

*Primary Examiner* — Andrew M Tecco
*Assistant Examiner* — Praachi M Pathak
(74) *Attorney, Agent, or Firm* — Oliff PLC

(57) ABSTRACT

A hammer drill (101) comprises a main body (103) which houses a driving motor (110) and a driving mechanism and a handle (109) which is movable to the main body (103). Further, a coil spring (160) which biases the handle (109) is provided. In a state that the coil spring (160) biases the handle (109), the handle (109) is moved against the main body (103) in a longitudinal direction of a hammer bit (119) and vibration transmission from the main body (103) to the handle (109) is prevented.

14 Claims, 9 Drawing Sheets

(56) References Cited

FOREIGN PATENT DOCUMENTS

| | | | |
|---|---|---|---|
| WO | WO 2007/068535 | A2 | 6/2007 |
| WO | 2008/097555 | A1 | 8/2008 |

OTHER PUBLICATIONS

Mar. 15, 2017 Office Action issued in Japanese Patent Application No. 2013-244446.
Jul. 11, 2017 Office Action issued in Japanese Patent Application No. 2013-244446.

* cited by examiner

POWER TOOL

CROSS REFERENCE TO RELATED APPLICATION

The present application claims priority from Japanese Patent Applications No. 2013-244446 filed on Nov. 26, 2013, the entire contents of which are incorporated by reference herein.

FIELD OF THE INVENTION

The present invention relates to a power tool which drives a tool bit and performs a predetermined operation.

BACKGROUND OF THE INVENTION

WO 2007/068535 discloses a rotary hammer having a drive unit and a transmission unit. A driving torque of the drive unit is transmitted to the transmission unit and thereby an operation is performed. The rotary hammer further comprises a housing unit which houses the drive unit and another housing unit which houses the transmission unit. The housing unit for the drive unit has a main handle integrally jointed to it. Further, the housing unit for the drive unit and the housing unit for the transmission unit are moved relatively to each other and thereby transmission of vibration between the both housing unit is prevented.

SUMMARY OF THE INVENTION

Problem to be Solved by the Invention

In the rotary hammer described above, since the drive unit and the transmission unit are moved relatively to each other, a specially formed bellow-like transmitting member is utilized to allow the relative movement between both housing units and to transmit the drive torque from the drive unit to the transmission unit. However, to use the specially formed member which is not widely or generally used member may make price of the rotary hammer expensive, and further loss of the transmission of the drive torque may be increased.

Accordingly, an object of the present invention is, in consideration of the above described problem, to provide an improved technique for transmission of torque of the motor and a vibration proof of a main handle in a power tool.

Means for Solving the Problem

Above-mentioned problem is solved by the present invention. According to a preferable aspect of the invention, a power tool which drives a tool bit in a longitudinal direction of the tool bit and performs an operation is provided. The power tool comprises a motor which has an output shaft being parallel to the longitudinal direction of the tool bit, a driving mechanism which is connected to the output shaft of the motor and driven by the motor, a main body which houses the motor and the driving mechanism, a main handle which is movable with respect to the main body, a guide element which guides the main handle such that the main handle moves in the longitudinal direction of the tool bit with respect to the main body, and a biasing member which is arranged between the main body and the main handle and biases the main body and the main handle in the longitudinal direction of the tool bit. Further, the main handle moves against the main body in a state that the main handle is biased by the biasing member, and transmission of vibration generated during the operation from the main body to the main handle is prevented. Typically, in the power tool, the driving mechanism may include a movable member for driving the tool bit, and a moving direction of the movable member and the longitudinal direction of the tool bit may be in conformity to each other. Further, a moving direction of the main handle with respect to the main body may be preferably only along the longitudinal direction of the tool bit.

According to this aspect, the driving mechanism and the motor are housed in the main body. Therefore, a specially formed transmitting member to transmit rotation of the motor to the driving mechanism is not needed. Further, the main handle is movable against the main body in a state that the main handle is biased by the biasing member. Thus, vibration transmission from the main body to the main handle is prevented. As a result, both of transmission of rotation of the motor to the driving mechanism and reduction of vibration transmission to the main handle are effectively achieved. Further, the main handle is moved in the longitudinal direction of the tool bit by the guide element. In other words, the guide member can prevent the main handle from moving in other direction than the longitudinal direction of the tool bit. Therefore, compared with a known power tool in which a handle is moved in a several directions with respect to a main body, the biasing member reduces vibration in the longitudinal direction of the tool bit effectively. As a result, usability of the power tool is improved.

According to a further preferable aspect of the invention, a periphery of the motor is formed cylindrically. Further, the guide element is arranged outside the motor in a radial direction of the motor. Typically, the guide element may be formed by at least a pair of guide element components and the main handle may be arranged outside the main body. In such a construction, the guide element may be provided both on an outer surface of the main body which houses the motor and on an inner surface of the main handle.

According to this aspect, the guide element is arranged at the outer region of the motor. Thus, a sliding area of the main body and the main handle is defined so as to overlap to the motor in the longitudinal direction of the tool bit. Accordingly, the outer region (space) of the motor is rationally utilized.

According to a further preferable aspect of the invention, the guide element comprises a pair of guide element components. Typically, one of the guide element components is formed as a projection, and the other is formed as a recess which engages with the projection. Thus, the main handle is guided by the sliding between the projection and the recess. Further, the projection and the recess may extend in the longitudinal direction of the tool bit and the moving direction of the main handle with respect to the main body may be limited to the longitudinal direction of the tool bit. Further, a plurality of guide elements are arranged at respective positions which are different to each other in a circumference direction around the longitudinal direction of the tool bit. Further, respective guide elements may be arranged in positions with respect to the longitudinal direction of the tool bit. Further, the main handle includes a grip which extends in a direction crossing the longitudinal direction of the tool bit. Preferably, a plurality of the guide elements may be symmetrically arranged with respect to a plane which includes both of a longitudinal line of the tool bit and an extending line of the grip.

According to this aspect, the guide elements are arranged in respective positions in the longitudinal direction of the tool bit. Thus, movement of the main handle against the main body in the circumference direction is prevented. Accordingly, the main handle is stably guided in the longitudinal direction of the tool bit.

According to a further preferable aspect of the invention, a pair of the guide element components comprises a metallic guide member arranged on one member among the main body and the main handle and a resin guide member arranged on the other member among the main body and the main handle.

According to this aspect, a pair of the guide element components are provided with the metallic member and the resin member. Thus, the main handle is guided by sliding of the pair of the guide element components which are made of different materials. Accordingly, sliding resistance on a contact surface between the pair of the guide element components is reduced by the materials being different to each other. As a result, the main handle is moved smoothly with respect to the main body and transmission of vibration from the main body to the main handle is effectively prevented.

According to a further preferable aspect of the invention, the guide element includes a movement amount defining part which defines amount of movement of the main handle with respect to the main body in the longitudinal direction of the tool bit. Typically, the movement amount defining part may be provided by a contact surface of the recess which is contactable with the projection. That is, the contact surface may be arranged perpendicular to the longitudinal direction of the tool bit.

According to this aspect, movement amount of the main handle with respect to the main body is defined as an enough movement amount for reducing vibration of the main handle. Thus, usability of the power tool is ensured and transmission of vibration to the main handle is prevented.

According to a further preferable aspect of the invention, the main handle includes a grip portion which is held by a user and an auxiliary handle attachable portion to which an auxiliary handle is attached. Further, the grip portion and the auxiliary handle attachable portion are configured to move integrally in the longitudinal direction of the tool bit with respect to the main body.

According to this aspect, the grip portion and the auxiliary handle attachable portion are moved integrally. Therefore, an auxiliary handle which is attached to the auxiliary handle attachable portion and the grip portion of the main handle are moved simultaneously in the longitudinal direction of the tool bit. Accordingly, usability of the power tool is further improved.

According to a further preferable aspect of the invention, the power tool comprises a guide portion which guides the auxiliary handle attachable portion against the main body. Typically, the auxiliary handle attachable portion is arranged outside the main body and the guide portion is arranged both on the outer surface of the main body and on the inner surface of the auxiliary handle attachable portion.

According to this aspect, the guide portion which guides the auxiliary handle attachable portion is provided. Accordingly, the main handle which includes the auxiliary handle attachable portion is stably guided by both of the guide portion and the guide element.

According to a further preferable aspect of the invention, the auxiliary handle attachable portion includes a ring portion which has an outer periphery to which the auxiliary handle is attached. Typically, the auxiliary handle is attached on the ring portion such that the auxiliary handle surrounds the ring portion. Further, the ring portion is configured to surround a part of the main body.

According to this aspect, the auxiliary handle attached portion is strengthened (reinforced) due to the form of the ring portion, In a construction in which the auxiliary handle is attached by surrounding the ring portion, the auxiliary handle is stably mounted to the auxiliary handle attachable portion.

According to a further preferable aspect of the invention, the main handle includes a connecting portion which fixedly connects the grip portion and the auxiliary handle attachable portion. Further, the auxiliary handle attachable portion is arranged closer to the tool bit than the main handle in the longitudinal direction of the tool bit, and the grip portion is arranged opposite to the tool bit with respect to the auxiliary handle attachable portion in the longitudinal direction of the tool bit. That is, the auxiliary handle attachable portion is arranged on the front region of the main body and the grip portion is arranged on the rear region of the main body.

According to this aspect, the auxiliary handle attachable portion which is provided on the tool bit side and the grip portion which is provided on the opposite side in the longitudinal direction of the tool bit are coupled by the connecting portion. Accordingly, the auxiliary handle attachable portion is assembled from the tool bit side (front side) to the main body and the grip portion is assembled from the opposite side (rear side) to the main body, and thereafter the auxiliary handle attachable portion and the grip portion is coupled by the connecting portion. Accordingly, workability to assemble the main handle with respect to the main body is improved.

According to a further preferable aspect of the invention, the main body includes a housing member which houses the motor and the driving mechanism. Further, the auxiliary handle attachable portion includes a contact portion which is configured to contact with the housing member. Further, the contact portion defines amount of movement of the main handle far from the tool bit in the longitudinal direction of the tool bit by contacting with the housing member. Accordingly, the main handle is moved with respect to the main body within a predetermined region in a direction far from the tool bit.

According to this aspect, movement amount of the main handle is as an enough movement amount for reducing vibration of the main handle. Thus, usability of the power tool is ensured and transmission of vibration to the main handle is prevented.

According to a further preferable aspect of the invention, the biasing member comprises a plurality of biasing elements which are arranged at respective positions being different to each other in a circumference direction around the longitudinal direction of the tool bit. The biasing member is preferably provided with at least three biasing elements. Further, the plurality of the biasing elements may be arranged at the same interval in the circumference direction.

According to this aspect, the main handle is able to be evenly biased in the circumference direction by the biasing elements. That is, the main handle is biased in well balance with respect to the main body. As a result, movement of the main handle against the main body becomes stable.

According to a further preferable aspect of the invention, the power tool comprises a sealing member which seals a gap between the main handle and the main body.

According to this aspect, although a gap is formed between the main handle and the main body due to a relative movement between the main handle and the main body, the gap is covered (sealed) by the sealing member. Thus, dust is prevented from entering into a space between the main handle and the main body by the sealing member.

Accordingly, an improved technique for transmission of torque of the motor and a vibration proof of a main handle in a power tool is provided.

Other objects, features and advantages of the invention will be readily understood after reading the following detailed description together with the accompanying drawings and the claims.

DESCRIPTION OF THE PREFERRED EMBODIMENTS

Each of the additional features and method steps disclosed above and below may be utilized separately or in conjunction with other features and method steps to provide and manufacture improved power tools and method for using such power tools and devices utilized therein. Representative examples of the invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

(First Embodiment)

Figure 1:
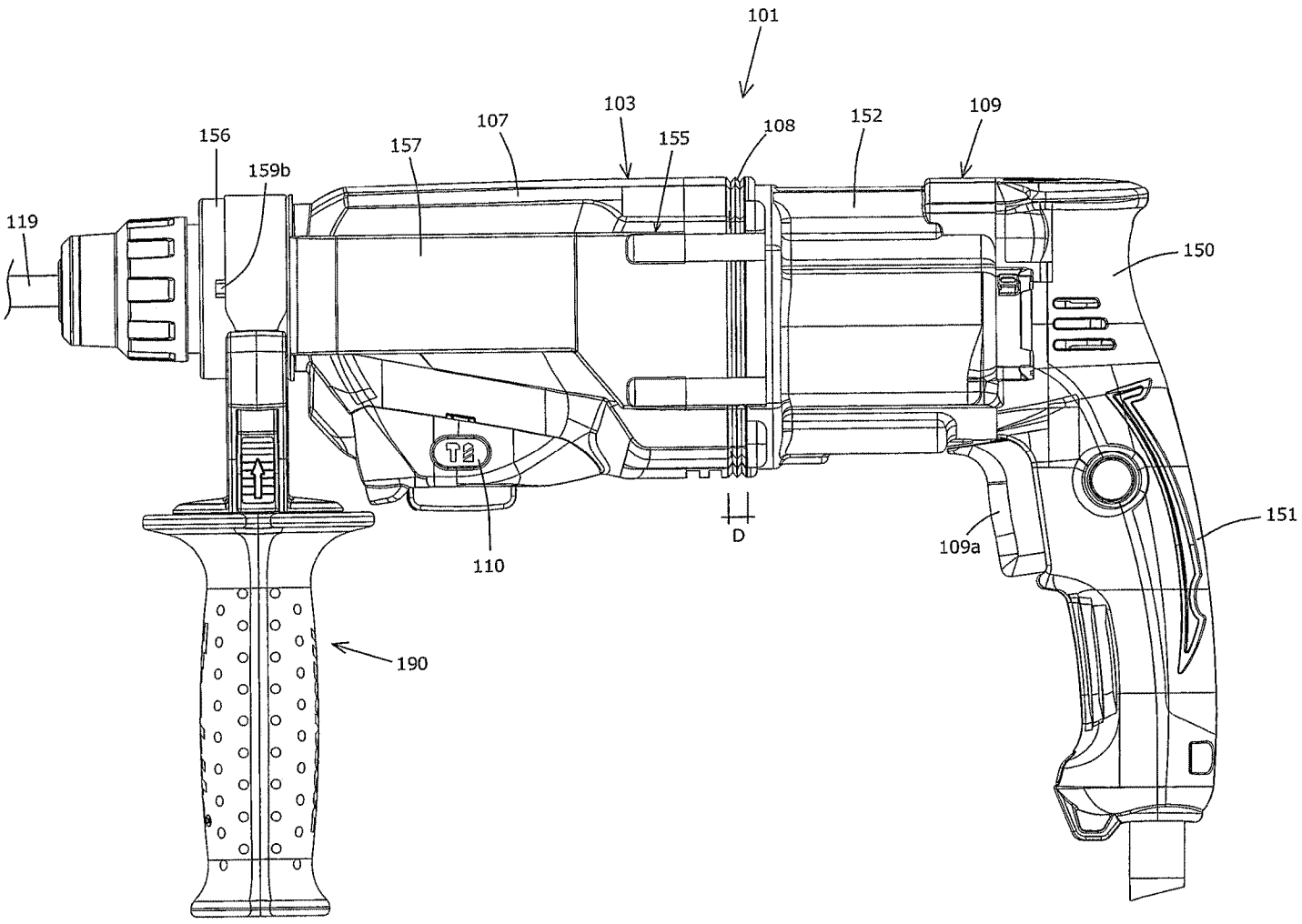
FIG. 1 shows a cross sectional view of a hammer drill according to an exemplary embodiment of the present invention.
Figure 2:
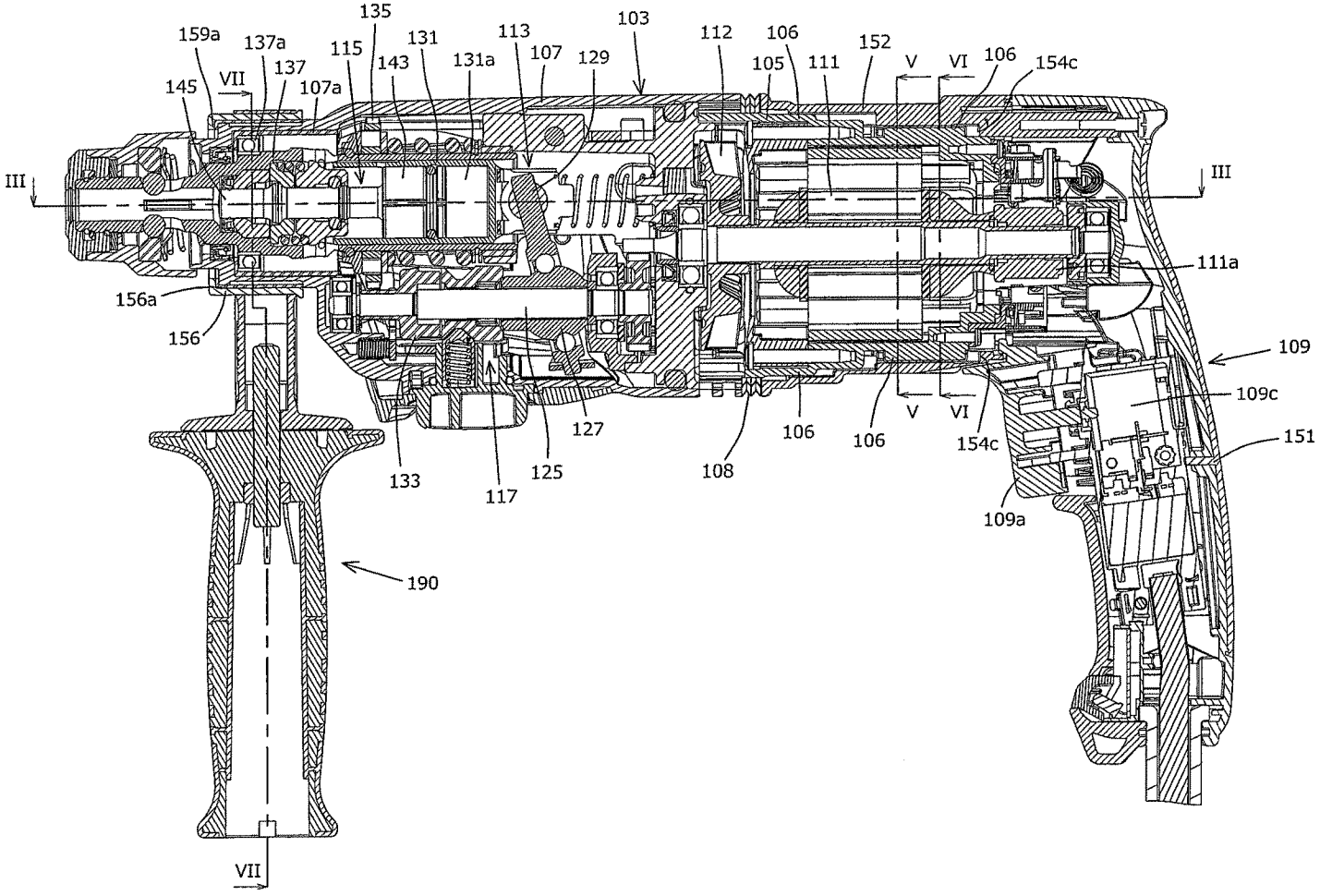
FIG. 2 shows a side cross sectional view of the hammer drill.
Figure 3:
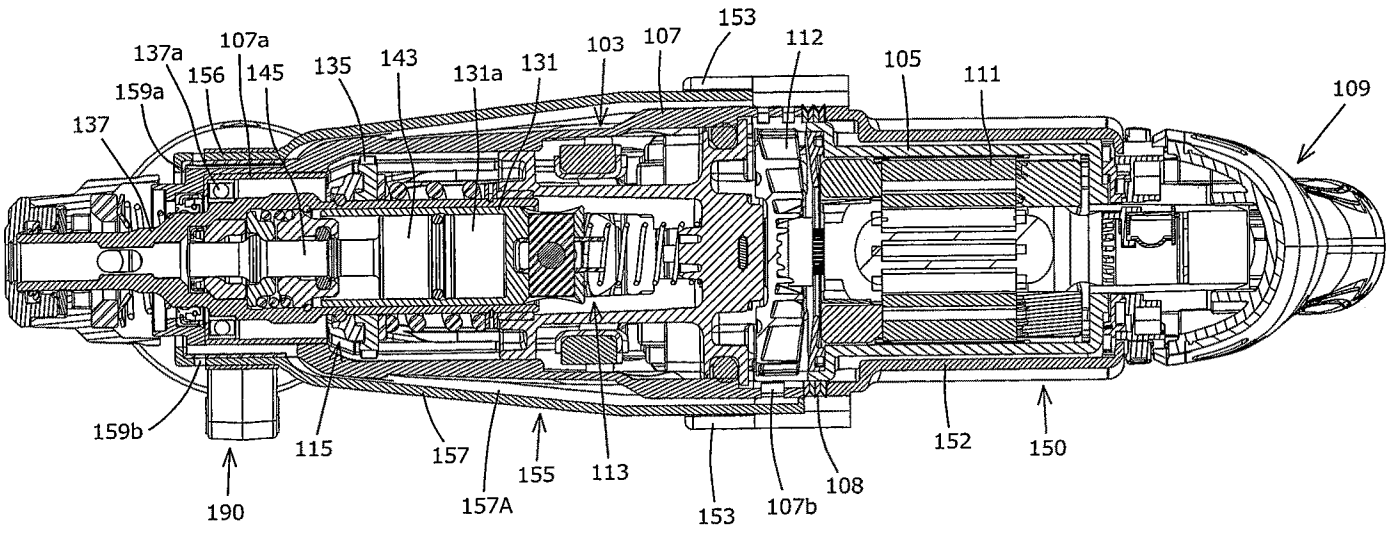
FIG. 3 shows a cross sectional view taken along the III-III line in FIG. 2.

An exemplary embodiment of the present invention is explained with reference to FIG. 1 to FIG. 10. An electrical hammer drill which corresponds to one example of a power tool is utilized to explain the present invention hereafter. As shown in FIG. 1, the hammer drill 100 is mainly provided, with a main body 103, a handle 109 and a hammer bit 119. As shown in FIG. 2 and FIG. 3, a tool holder 137 is arranged at a front region (left side in FIG. 2) of the main body 103 and the hammer bit 110 is detachably attached to the tool holder 137. A grip portion 151 of the handle 109 is arranged at a rear region of the main body 103 which is opposite to the front region in an axial direction of the hammer bit 119.

(Driving Mechanism)

Figure 4:
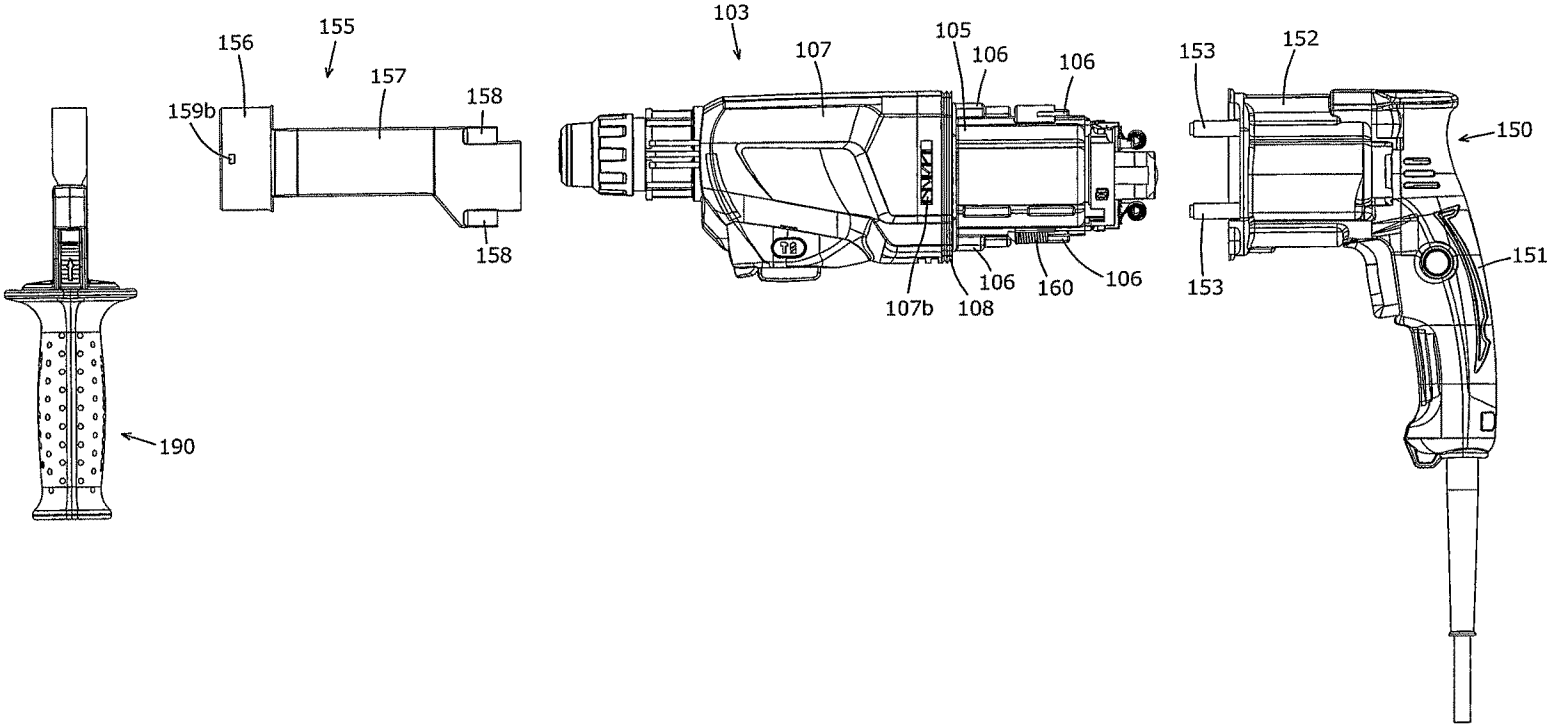
FIG. 4 shows an exploded side view of the hammer drill.

As shown in FIG. 2 to FIG. 4, the main body 103 is mainly provided with a motor housing 105 which houses a driving motor 111 and a gear housing 107 which houses a motion converting mechanism 113, a hammering element 115 and a rotation transmission mechanism 117. The gear housing 107 comprises a bearing holding portion 107*a* at its front region, which holds a bearing 137*a* for supporting the tool holder 137. Further, the gear housing 107 comprises an opening 107*b* which communicates inside the gear housing 107 with the outside the gear housing 107. The driving motor 111 is one example which corresponds to "a motor" according to the present invention. Each of the motion converting mechanism 113, the hammering element 115 and the rotation transmission mechanism 117 is one example which corresponds to "a driving mechanism" according to the present invention. Further, the main body 103 is one example which corresponds to "a main body" according to the present invention.

The driving motor ill is arranged such that its rotation axis extends parallel to a longitudinal direction of the hammer bit 119. A cooling fan 112 is mounted on a rotation shaft of the driving motor 111 at a front region of the driving motor 111. That is, the cooling fan 112 is arranged between the driving mechanism and the driving motor ill with respect to the longitudinal direction of the hammer bit 119. When the driving motor 111 is turned on, the cooling fan 112 is driven and thereby a cooling air is generated. The cooling fan 112 is formed as a centrifugal fan. The cooling air which is flowed through inside the gear housing 107 is discharged from the opening 107*b* which is formed on a side surface of the gear housing 107. That is, the opening 107*b* is provided so as to correspond to the cooling fan 112. A rotational output (torque) of the driving motor 111 is converted to a linear motion in the longitudinal direction of the hammer bit 119 by the motion converting mechanism 113 which is arranged in front of the driving motor 111. Further, the linear motion is transmitted to the hammering element 115 and thereby impact force (hammering force) in the longitudinal direction (lateral direction of the FIG. 1) of the hammer bit 119 is generated by the hammering element 115. Further, the rotational output (torque) is transmitted to the rotation transmission mechanism 117 which is arranged in front of the driving motor 111, and then rotation speed of the rotational output is reduced and transmitted to the hammer bit 119. Thus, the hammer bit 119 is rotationally driven. The driving motor 111 is driven (turned on) when a trigger 109*a* arranged on the handle 109 is manipulated (pulled). For convenience; the hammer bit 119 side of the hammer drill 101 is defined as a front side, and the handle 109 side of the hammer drill 101 is defined as a rear side.

The motion converting mechanism 113 is mainly provided with an intermediate shaft 125, a swing member 129 and a cylindrical piston 131. The intermediate shaft 125 is arranged parallel to the rotation shaft of the driving motor 111 and driven by the driving motor 111. When the intermediate shaft 125 is rotationally driven, the swing member 129 is swung in the longitudinal direction of the hammer bit 119 via a rotation body 127 mounted on the intermediate shaft 125. When the swing member 129 is swung, the cylindrical piston 131 is linearly driven (reciprocated) in the longitudinal direction.

The rotation transmission mechanism 117 is mainly provided with a speed reducing gear mechanism which comprises a plurality of gears. The speed reducing gear mechanism is provided with a small diameter gear 133 which is driven integrally with the intermediate shaft 125 and a large diameter gear 135 which meshes with the small diameter gear 133. The rotation transmission mechanism 117 transmits rotation of the driving motor 111 to the tool holder 137. The tool holder 137 is rotatably supported by the bearing 137*a* which is held on the bearing holding portion 107*a*. Accordingly, the tool holder 137 is rotationally driven and thereby the hammer bit 119 held by the tool holder 137 is rotationally driven. The bearing holding portion 107*a* is formed as a metallic cylindrical member made by aluminum like that.

The hammering element 115 is mainly provided with a striker 143 and an impact bolt 145. The striker 143 is provided as a hammering element which is slidably arranged within the cylindrical piston 131. The impact bolt 145 is provided as an intermediate element which is slidably arranged within the tool holder 137. The striker 143 is driven (slid) by an air spring (air fluctuation) of an air chamber 131*a* caused by the driving of the cylindrical piston 131 and strikes the impact bolt 145. Accordingly, the hammering force on the hammer bit 119 is caused by the impact bolt 145.

In the hammer drill 101 described above, when the driving motor 111 is electrically driven, rotation of the driving motor 111 is converted into the linear motion by the motion converting mechanism 113 and then transmitted to the hammer bit 119 via the hammering element 115. Thus, the hammer bit 119 is linearly driven. Further, rotation of the driving motor 111 is transmitted to the hammer bit 119 via the rotation transmission mechanism 117. Thus, the hammer bit 119 is rotationally driven. As a result, the hammer bit 119 performs a hammer drill operation on a workplace by the linear and rotational motion of the hammer bit 119.

As to driving modes of the hammer drill 101, as shown in FIG. 1, the hammer drill 101 comprises a mode select switch 110 for switching the driving modes. When a user manipulates the mode select switch 110, a hammer drill mode and a drill mode as the driving mode of the hammer drill 101 is switched. In the hammer drill mode, the hammer bit 119 is linearly and rotationally driven, in the drill mode, the hammer bit 119 is only rotationally driven.

(Main Handle)

As shown in FIG. 4, the handle 109 is served as a main handle made of resin, which is held by a user. The handle 109 is mainly provided with a handle rear side part 150 and a handle front side part 155. The handle rear side part 150 is mainly provided with a grip portion 151 which is held by a user and a cylindrical housing portion 152 which is arranged in front of the grip portion 151. The grip portion 151 is connected at a rear end of the housing portion 152 and extended downward from a connecting portion of the grip portion 151 and the housing portion 152. Namely, the grip portion 151 extends in a vertical direction crossing the longitudinal direction of the hammer bit 119. The distal end of the grip portion 151 is formed as a free end, and a cable for providing an electrical current to the hammer drill 101 is connected to the distal end of the grip portion 151. Further, the housing portion 152 includes an engagement projection 153 which protrudes frontward from the housing portion 152. In this embodiment, two projections 153 are provided. The grip portion 151 is one example which corresponds to "a grip portion" according to the present invention.

Figure 7:
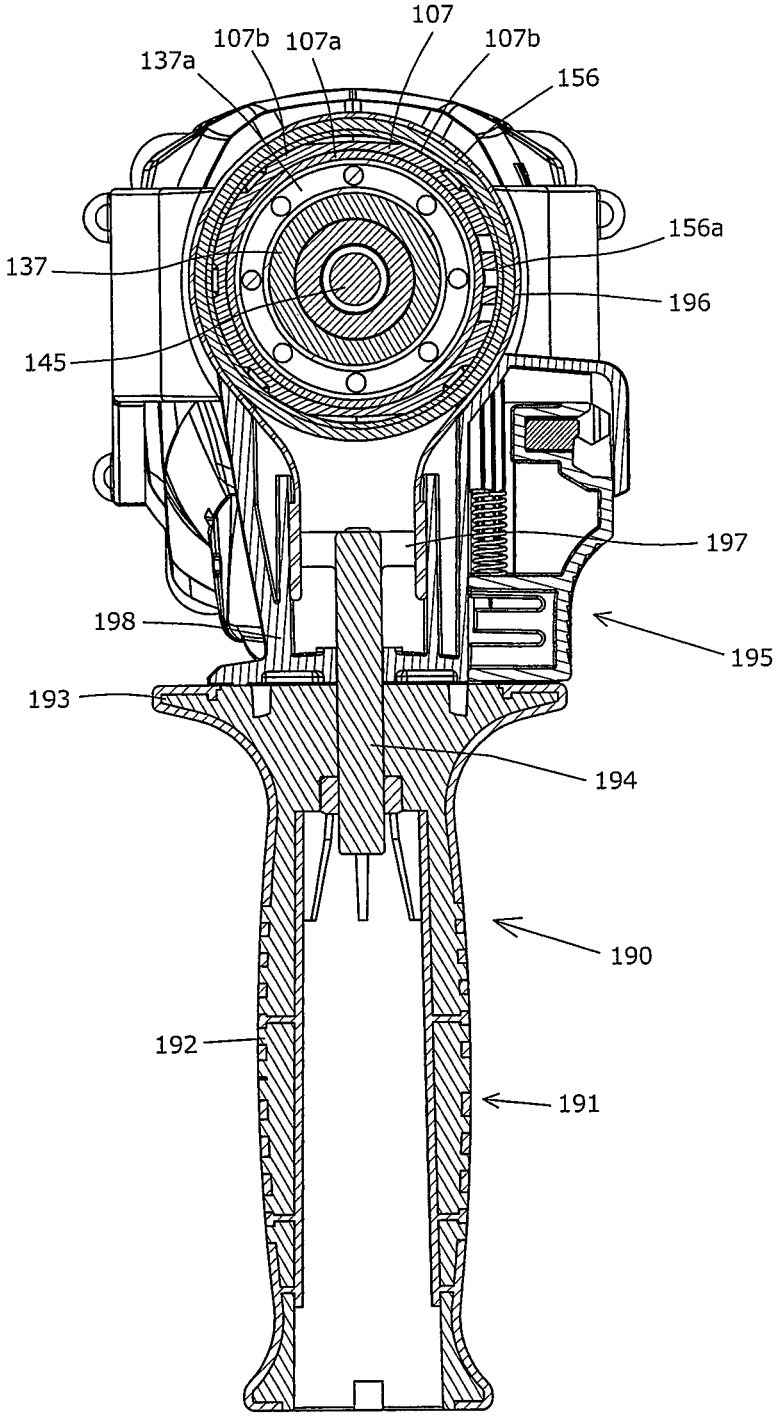
FIG. 7 shows a cross sectional view taken along the VII-VII line in FIG. 2.

The handle front side portion 155 is mainly provided with an auxiliary handle attachable portion 156 to which an auxiliary handle is attached and an extending portion 157 which is extended in the longitudinal direction of the hammer bit 119. The extending portion 157 is arranged at a rear of the auxiliary handle attachable portion 156. The auxiliary handle attachable portion 156 is formed as a ring-like member which surrounds the bearing holding portion 107*a* of the gear housing 107. Specifically, as shown in FIG. 7, the bearing holding portion 107*a* is arranged at the front region (hammer bit 119 side region) of the gear housing 107. Further, the bearing holding portion 107*a* has a plurality of projections 107*c* which are arranged at the periphery of the bearing holding portion 107*a* in predetermined interval in the circumference direction. Further, the auxiliary handle attachable portion 156 has a reinforcing ring 156*a* which engages with the top of the projections 107*c*. Further, as shown in FIG. 4, the extending portion 157 has an engagement recess 158 which is engagable with the engagement projection 153. The auxiliary handle attachable portion 156 is one example which corresponds to "an auxiliary handle attachable portion" according to the present invention. Further, the reinforcing ring 156*a* is one example which corresponds to "a ring portion" according to the present invention. Further, the extending portion 157 is one example which corresponds to "a connecting portion" according to the present invention.

Further, as shown in FIG. 4, the motor housing 105 has a plurality of sliding guides 106. Each sliding guide 106 is disposed at respective outside position of the motor housing 105 (driving motor 111) in the circumference direction around the longitudinal direction of the hammer bit 119. Further, the sliding guides 106 are disposed at a front side region and a rear side region respectively with respect to the longitudinal direction of the hammer bit 119. Accordingly, the front side sliding guides 106 and the rear side sliding guides 106 are respectively disposed in a plurality positions on the motor housing 105 in the circumference direction of longitudinal direction of the hammer bit 119. The sliding guide 106 is provided with a metallic cover which covers a projection made of resin. The projection is formed on the surface of the motor housing 105. The metallic cover is made of metallic material such as steel, aluminum, magnesium, titanium and so on. Further, a plurality of coil springs 160 are disposed on an outer surface of the motor housing 105. The sliding guide 106 is one example which corresponds to "a metallic guide member" according to the present invention.

Figure 5:
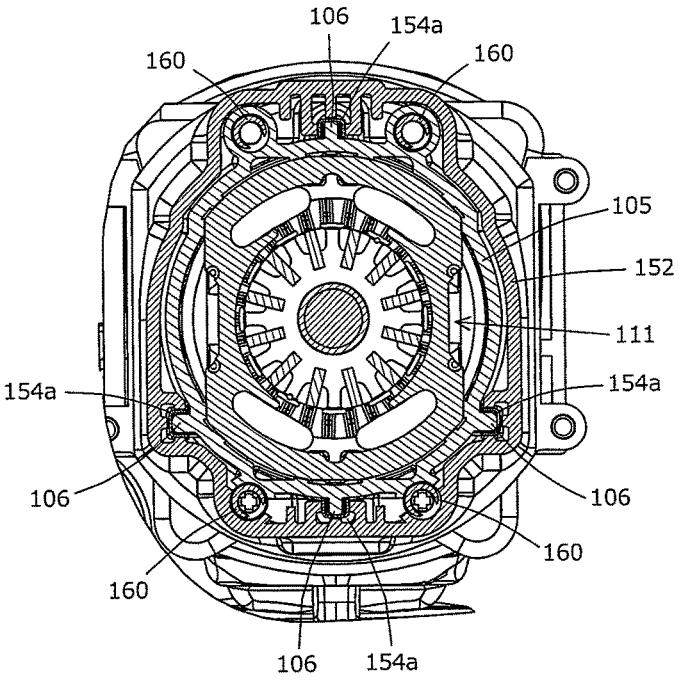
FIG. 5 shows a cross sectional view taken along the V-V line in FIG. 2.
Figure 6:
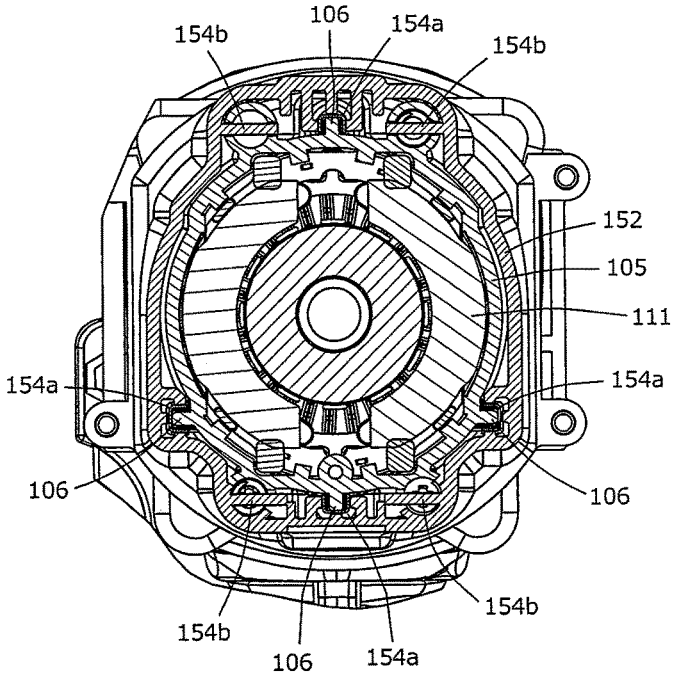
FIG. 6 shows a cross sectional view taken along the VI-VI line in FIG. 2.

As shown in FIG. 5 and FIG. 6, a plurality of recesses 1511*a* which correspond to respective sliding guides 106 and a plurality of pressing portions 154*b* which correspond to respective coil springs 160 are disposed on an inner surface of the housing portion 152. The recess 154*a* is formed as a part of the housing portion 152 and therefore made of a resin such as polyamide (nylon). Further, as shown in FIG. 2, a contact portion 154*c* contactable with the sliding guide 106 is provided on the rear end of the recess 154*a*. Further, a contact portion 159*a* contactable with the front part of the gear housing 107 is provided at the front end of the auxiliary handle attachable portion 156. Further, as shown in FIG. 4, a through hole 159*b* is formed on the auxiliary handle attachable portion 156, The recess 154*a* is one example which corresponds to "a resin guide member" according to the present invention.

As shown in FIG. 1 to FIG. 3, the handle 109 described above is assembled outside the main body 103 such that the handle rear side part 150 is moved from the rear of the main body 103 and the handle front side part 155 from the front of the main body 103, and thereafter the handle rear side part 150 and the handle front side part 155 are connected by engagement of the engagement projection 153 and the engagement recess 158. Thus, the handle 109 is provided such that the housing portion 152 surrounds the motor housing 105 and the extending portion 157 extends along the gear housing 107. When assembled, the extending portion 157 forms a cooling air passage 157A from the opening 107*b* through the through hole 159*b* of the auxiliary handle attachable portion 156 between, the extending portion 157 and the gear housing 107. The extending portion 157 has a U-shaped cross section orthogonal to an extending direction of the extending portion 157, and therefore the cooling air passage 157A is provided from the opening 107*b* formed on the side surface of the gear housing 107 to the front region of the gear housing 107 to which the hammer bit 119 is attached. Further, the housing portion 152 is arranged outside the motor housing 105 such that the recess 154*a* engages with the sliding guide 106 and the pressing portion 154*b* presses the coil spring 160. Thus, one end of the coil spring 160 contacts with the motor housing 105 and another end of the coil spring 160 contacts with the pressing portion 154*b* of the housing portion 152 and therefore the coil spring 160 biases the handle rear side part 150 from the motor housing 105. Thus, the handle rear side part 150 is pressed rearward by the coil spring 160 and at this time the contact portion 159*a* of the handle front side part 155 contacts with the front end part of the gear housing 107, and therefore, the rear position of the handle 109 is defined. The coil spring 160 is one example which corresponds to "a biasing member" according to the present invention. Further, the handle 109 is one example which corresponds to "a main handle" according to the present invention.

A bellow-like member 108 is arranged between the gear housing 107 and the handle rear side portion 150. The bellow-like member 108 is an annular rubber member surrounding the gear housing 107 and extendable and contractable in the longitudinal direction of the hammer bit 119. Accordingly, a relative movement of the handle 109 against the gear housing 107 in the longitudinal direction of the hammer bit 119 is allowed. The bellow-like member 108 is also served as a sealing member which seals a gap between the main body 103 and the handle 109. The bellow-like member 108 is one example which corresponds to "a sealing member" according to the present invention.

(Auxiliary Handle)

As shown in FIG. 7, the auxiliary handle 190 is configured to attach to the auxiliary handle attachable portion 156 of the handle 109. The auxiliary handle 190 is mainly provided with a holding portion 191 and an attaching portion 195. The holding portion 191 has a grip 195, a flange 193 and a bolt 194. The grip 192 is a substantially cylindrical resin member, which is held by a user. The flange 193 is provided at one end of the grip 192. The bolt 194 is provided such that it extends in a longitudinal direction of the grip 192 and protrudes from the flange 193. The attaching portion 195 has an engagement band 196, a nut 197 and a band holding portion 198. The engagement band 196 is a substantially annular band-like member and both ends of the band are connected to the nut 197. The band holding portion 198 is provided outside the engagement band 196 to support the engagement band 196. A through hole into which the bolt 196 penetrates is formed at a center region of the band holding portion 198.

In the auxiliary handle 190 described above, the bolt 194 is screwed to the nut 197 and unscrewed from the nut 197 by rotating the holding portion 191 around the longitudinal direction of the holding portion 191 against the band holding portion 198. Accordingly, a distance between the nut 197 and the flange 193 is changed. In a state that the engagement band 196 is arranged so as to surround the auxiliary handle attachable portion 156 of the handle 109, when the holding portion 191 is rotated in one direction around its axis, the engagement band 196 clamps the auxiliary handle attachable portion 156. At this time, the band holding portion 193 is interveningly arranged between the engagement band 196 and the flange 193 and thereby the auxiliary handle 190 is mounted to the auxiliary handle attachable portion 156. That is, the auxiliary handle 190 is attached so as to cover (surround) the auxiliary handle attachable portion 156. While, when the holding portion 191 is rotated in another direction around its axis, the engagement band 196 releases the auxiliary handle attachable portion 156. Accordingly, the auxiliary handle 190 is detached from the auxiliary handle attachable portion 156.

(Driving of Hammer Drill)

In the hammer drill 110 described above, when a user pulls the trigger 109*a*, the driving motor 111 is turned on. Accordingly, a hammer operation or a hammer drill operation is performed based on the driving mode selected by the mode select switch 110. During the operation by the hammer drill 101, vibration mainly in the longitudinal direction of the hammer bit 119 is occurred on the main body 103. At this time, as the handle 109 is movable with respect to the main body 103 in the longitudinal direction of the hammer bit 119, the handle 109 moves in the longitudinal direction of the hammer bit 119 based on vibration occurred during the operation.

Figure 8:
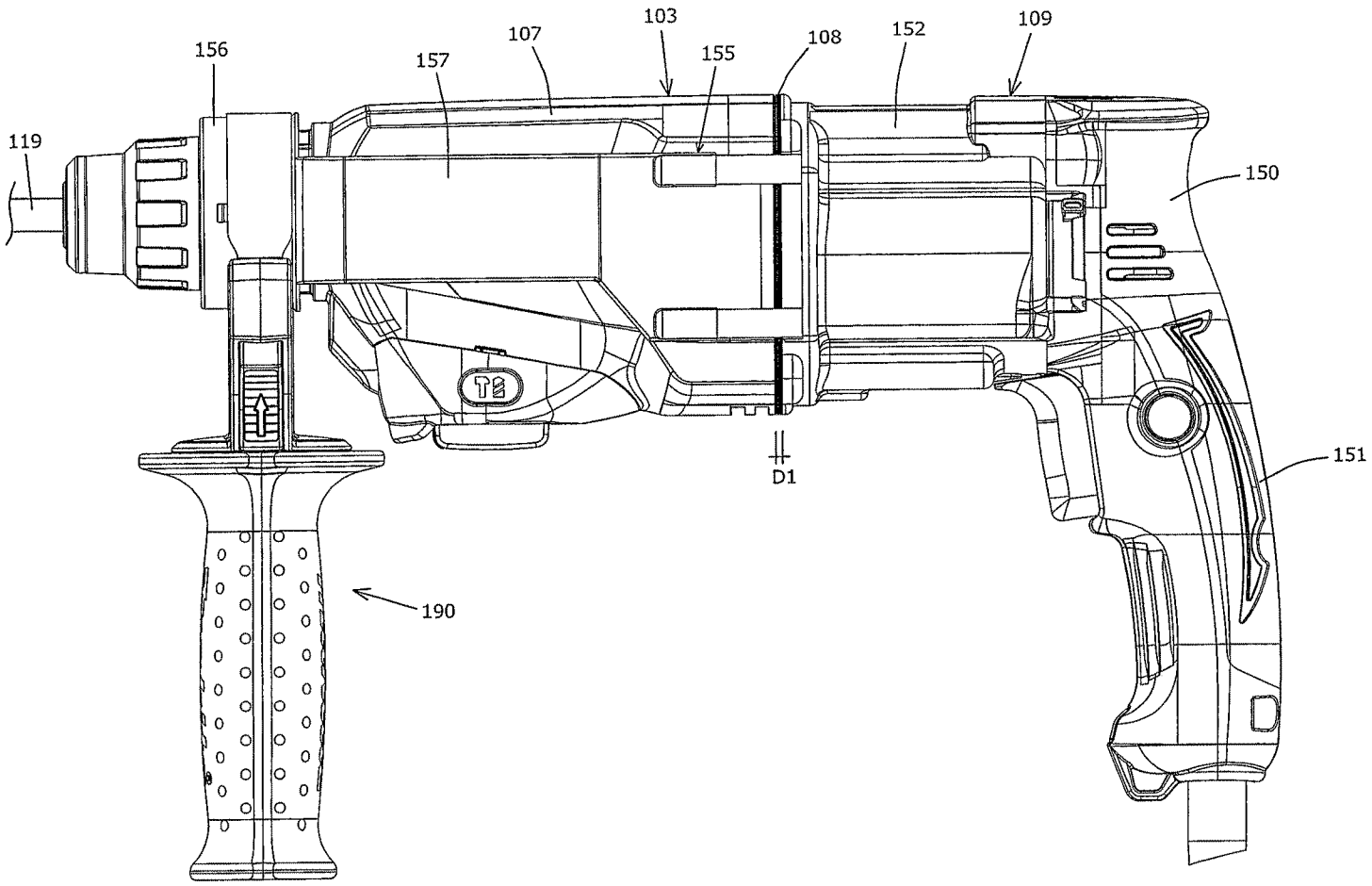
FIG. 8 shows a side view in which a main handle is positioned in a front position.
Figure 9:
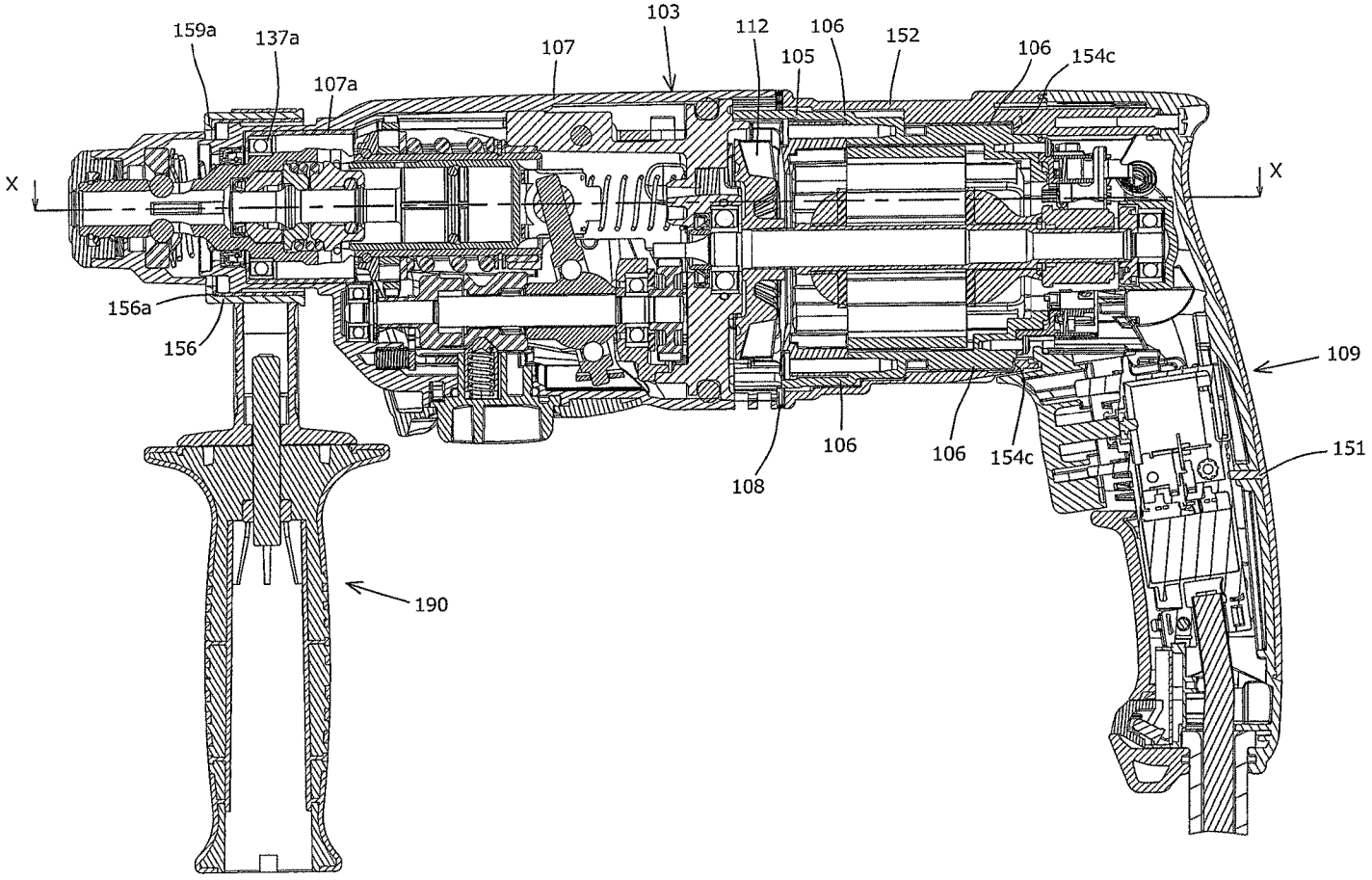
FIG. 9 shows a cross sectional view of FIG. 8.
Figure 10:
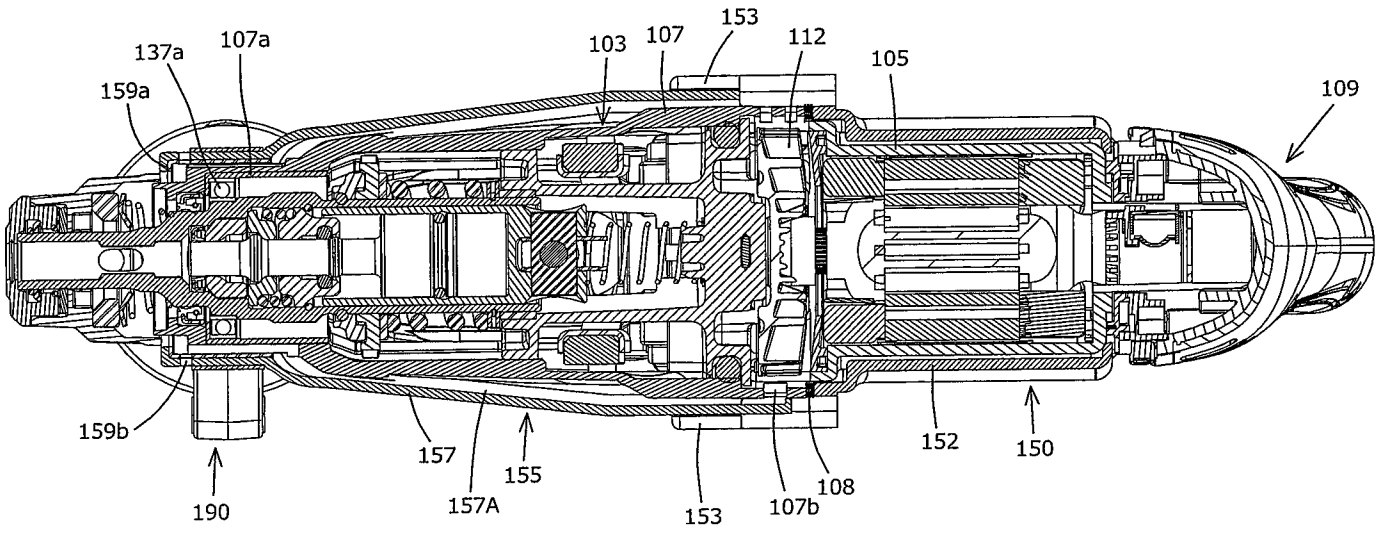
FIG. 10 shows a cross sectional view taken along the X-X line in FIG. 9.

Specifically, as shown in FIG. 1 to FIG. 3 and FIG. 8 to FIG. 10, the main body 103 and the handle 109 are relatively moved to each other in the longitudinal direction of the hammer bit 119. FIG. 1 to FIG. 3 illustrate the hammer drill 101 in which the handle 109 is positioned in relatively rear position against the main body 103. Further, FIG. 8 to FIG. 10 illustrate the hammer drill 101 in which the handle 109 is positioned in relatively front position against the main body 103.

As shown in FIG. 1 to FIG. 3, the handle 109 is positioned in a rear position by biasing force of the coil spring 160 (shown in FIG. 4 and FIG. 5). In the rear position, the housing portion 152 is disposed in distance D from the main body 103. The rear position is defined by contact between the contact portion 159*a* and the front end part of the gear housing 107. Accordingly, the bellow-like member 108 is held in length D between the main body 103 and the housing portion 152. Further, as the auxiliary handle 190 is mounted on the auxiliary handle attachable portion 156 which is a part of the handle 109, the auxiliary handle 190 is also positioned in the rear position together with the handle 109. The contact portion 159*a* is one example which corresponds to "a contact portion" according to the present invention. Further, the motor housing 105 and the gear housing 107 are one example which corresponds to "a housing member" according to the present invention.

On the other hand, as shown in FIG. 8 to FIG. 10, the handle 109 is positioned in a front position against the biasing force of the coil spring 160 in a state that the biasing force of the coil spring 160 is applied to the handle 109. In the front position, the housing portion 152 is disposed in distance Di from the main body 103. The distance D1 is shorter than the distance D. The front position is defined by contact between contact portion 154*c* and the rear end part of the sliding guide 106. Accordingly, the bellow-like member 108 is held in length D1 between the main body 103 and the housing portion 152. At this time, the auxiliary handle 190 is positioned in the front position together with the handle 109. The rear end part of the sliding guide 106 is one example which corresponds to "a movement amount defining part" according to the present invention.

The sliding guide 106 and the recess 154*a* are provided so as to extend parallel to the longitudinal direction of the hammer bit 119. The handle 109 is moved in a state that the sliding guide 106 of the motor housing 105 and the recess 154*a* of the handle rear side part 150 are engaged with each other, and thereby a moving direction of the handle 109 between the front position and the rear position is defined as being parallel to the longitudinal direction of the hammer bit 119. Further, the reinforcing ring 156*a* of the auxiliary handle attachable portion 156 is slid on the projection 107*c* of the gear housing 107 and thereby a moving direction of the auxiliary handle attachable portion 156 is defined as being parallel to the longitudinal direction of the hammer bit 119. The sliding guide 106 and the recess 154*a* are one example which corresponds to "a guide element" according to the present invention, that is, the sliding guide 106 and the recess 154*a* correspond to "a pair of guide element components" according to the present invention. Further, each of the reinforcing ring 156*a* and the projection 107*c* is one example which corresponds to "a guide portion" according to the present invention.

As described above, in a state that the handle 109 is biased by the coil spring 160, the handle 109 is reciprocally moved between the front position and the rear position by the vibration in the longitudinal direction of the hammer bit 119 during the operation. Thus, kinetic energy of the vibration is consumed by extension and contraction of the coil spring 160, and thereby vibration transmission from the main body 103 to the handle 109 is reduced.

The cooling air generated by the cooling fan 112 is exhausted from inside to outside the gear housing 107 via the opening 107*b*. Thereafter, the cooling air is flowed the cooling air passage 157A between the gear housing 107 and the extending portion 157. Further, the cooling air is passed along the outer surface of the metallic bearing holding portion 107*a* and then exhausted to outside of the hammer drill 101 via the through hole 159*b*. When the cooling air passes the metallic bearing holding portion 107*a*, the bearing 137*a* which is held by the bearing holding portion 107*a*. is cooled. As shown in FIG. 3 and FIG. 10, the opening 107*b* is not closed (covered) by the handle 109 which is positioned not only in the front position but also in the rear position. Thus, an opening area of the opening 107*b* is not changed even when the handle 109 is moved. Accordingly, air flow rate of the cooling air is maintained.

According to this embodiment described above, the sliding guide 106 guides the handle 109 in the longitudinal direction of the hammer bit 119. Accordingly, in the hammer drill 101 in which vibration mainly in the longitudinal direction of the hammer bit 119 is occurred, since a main direction of the vibration and the moving direction of the handle 109 are in conformity to each other, vibration transmission to the handle 109 is effectively reduced. Further, the driving motor 111 is housed in the motor housing 105 of the main body 103, therefore the lightweight handle 109 is provided. As a result, vibration of the handle 109 is effectively reduced without increasing a consumption amount of kinetic energy of the vibration, by the coil spring 160. Further, a distance between the driving motor 111 and the motion converting mechanism 113 as well as the rotation transmission mechanism 117 is maintained constant. Accordingly, a specially formed transmitting member which is not widely or generally used member such as a bellow-like transmitting member for transmitting rotation of the driving motor 111 to the motion converting mechanism 113 or the rotation transmission mechanism 117 is not needed.

Further, according to this embodiment, a plurality of sliding guide 106 are arranged around the longitudinal direction of the hammer bit 119, Thus, the handle 109 is prevented from moving in a direction other than the longitudinal direction of the hammer bit 119. That is, the handle 109 is moved only in the longitudinal direction of the hammer bit 119. As a result, usability of the hammer drill 101 in which the handle 109 is moved against the main body 103 is improved.

Further, according to this embodiment, the handle 106 is guided by the metallic sliding guide 106 and the resin recess 154*a*, When the handle 109 is moved, a sliding between different materials is occurred. Accordingly, sliding resistance between the sliding guide 106 and the recess 154*a* is decreased, and thereby the handle 109 is smoothly moved. As a result, vibration transmission to the handle 109 is effectively reduced.

Further, according to this embodiment, the handle rear side part 150 and the handle front side part 155 are moved integrally. Therefore, a distance between the grip portion 151 of the handle rear side part 150 and the auxiliary handle 190 which is attached to the auxiliary handle attachable portion 156 of the handle front side part 155 is maintained constant. Accordingly, usability for a user holding the grip portion 151 and the auxiliary handle 190 is improved.

Further, according to this embodiment, the extending portion 157 connects the auxiliary handle attachable portion 156 with the housing portion 152 and farther forms the cooling air passage 157A. Therefore, another member providing a cooling air passage for cooling the bearing 137*a* which holds the tool holder 137 is not necessary. Accordingly, number of members of the hammer drill 101 is reduced.

Further, according to this embodiment, a plurality of coil springs 160 are arranged around the longitudinal direction of the hammer bit 119. Thus, the handle 109 is stably biased by the springs 160. As a result, vibration transmission to the handle 109 is effectively reduced by the plurality of springs 160.

Further, according to this embodiment, coil springs 160 and sliding guides 106 are arranged in the same region with respect to the longitudinal direction of the hammer bit 119. Further, the coil springs 160 and the sliding guides 106 are arranged at respective positions which are different to each other with respect to the circumference direction around the hammer bit 119. Accordingly, outer space of the driving motor 111 is rationally utilized.

Further, according to this embodiment, the cooling air flows between the auxiliary handle attachable portion 156 and the gear housing 107, Accordingly, heat generated by a relative sliding of the auxiliary handle attachable portion 156 to the gear housing 107 is effectively discharged to the air.

In the embodiment described above, the coil spring 160 is disposed as a biasing member, however other kind of spring or a rubber like that may be applied to the present invention. Further, the sliding guide 106 maybe formed by resin and the recess 154*a* may be formed by metal . Further, the power tool, according to the present invention is not limited to the hammer drill 101. That is, an electric hammer or a reciprocating saw may be applied to the present invention as a power tool, as long as a power tool generates vibration in a predetermined longitudinal direction.

Having regard to an aspect of the invention, following features are provided, Each feature may be utilized independently or in conjunction with other feature(s) or claimed invention(s).

(Feature 1)

A power tool to which an auxiliary handle is attached, the power tool being configured to drive a movable member reciprocally in a longitudinal direction and performs a predetermined operation by a tool bit driven by the movable member, the power tool comprising:

a motor which has an output shaft being parallel to the longitudinal direction, a driving mechanism which has the movable member, the driving mechanism being connected to the output shaft and the movable member being driven by the motor, a main body which houses the motor and the driving mechanism, a main handle which is movable with respect to the main body, a guide element which guides the main handle such that the main handle moves only in the longitudinal direction with respect to the main body, and a biasing member which is arranged between the main body and the main handle and biases the main body and the main handle in the longitudinal direction, wherein the main handle moves against the main body in a state that the main handle is biased by the biasing member, and transmission of vibration generated during the operation from the main body to the main handle is prevented.

(Feature 2)

The movable member is served as an impact bolt which is configured to strike the tool bit.

(Feature 3)

The guide element is provided with a pair of guide element components, and the plurality of the guide element components are arranged in respective positions which are different in the longitudinal direction of the tool bit.

(Feature 4)

The ring portion is formed such that a radial force is applied from the auxiliary handle and the auxiliary handle is attached to the ring portion.

(Feature 5)

The main handle is assembled on the main body such that the auxiliary handle attachable portion is moved from the front to the rear of the main body in the longitudinal direction and the grip portion is moved from the rear to the front of the main body in the longitudinal direction and the auxiliary handle attachable portion and the grip portion are connected by the connecting portion.

(Feature 6)

The biasing member is provided with at least three biasing elements.

A correspondence relation between each components of the embodiments and features of the invention is explained as follows. Further, each embodiment is one example to utilize the invention therefore the invention is not limited to the embodiments.

The hammer drill 101 corresponds to "a power tool" of the invention.

The driving motor 111 corresponds to "a motor" of the invention.

The motion converting mechanism 113 corresponds to "a driving mechanism" of the invention.

The hammering element 115 corresponds to "a driving mechanism" of the invention.

The rotation transmission mechanism 117 corresponds to "a driving mechanism" of the invention.

The main body 103 corresponds to "a main body" of the invention.

The motor housing 105 corresponds to "a main body" of the invention.

The gear housing 107 corresponds to "a main body" of the invention.

The handle 109 corresponds to "a main handle" of the invention.

The sliding guide 106 corresponds to "a guide element" of the invention.

The sliding guide 106 corresponds to "a metallic guide member" of the invention.

The sliding guide 106 corresponds to "a guide element component" of the invention.

The recess 154*a* corresponds to "a guide element" of the invention.

The recess 154*a* corresponds to "a resin guide member" of the invention.

The recess 154*a* corresponds to "a guide element component" of the invention.

The coil spring 160 corresponds to "a biasing member" of the invention.

The contact portion 154*c* corresponds to "a movement amount defining part" of the invention.

The grip portion 151 corresponds to "a grip portion" of the invention.

The auxiliary handle attachable portion 156 corresponds to "an auxiliary handle attachable portion" of the invention.

The extending portion 157 corresponds to "a connecting portion" of the invention.

The reinforcing ring 156*a* corresponds to "a ring portion" of the invention.

The bellow-like member 108 corresponds to "a sealing member" of the invention.

DESCRIPTION OF NUMERALS

101 hammer drill
103 main body
105 motor housing
106 sliding guide
107 gear housing
107*a* bearing holding portion
107*b* opening
107*c* projection
108 bellow-like member
109 handle
109*a* trigger
110 mode select switch
111 driving motor
112 cooling fan
113 motion converting mechanism
115 hammering element
117 rotation transmission mechanism
119 hammer bit
125 intermediate shaft
127 rotatable body
129 swing member
131 cylindrical piston
131*a* air chamber
133 small diameter gear
135 large diameter gear
137 tool holder
137*a* bearing
143 striker
145 impact bolt
150 handle rear side part
151 grip portion
152 housing portion
153 engagement projection
154*a* recess

154*b* pressing portion
154*c* contact portion
155 handle front side part
156 auxiliary handle attachable portion
156*a* reinforcing ring
157 extending portion
1557A cooling air passage
158 engagement recess
159*a* contact portion
159*b* through hole
160 coil spring
190 auxiliary handle
191 holding portion
192 grip
193 flange
194 bolt
195 attaching portion
196 engagement band
197 nut
198 band holding portion

What is claimed is:

1. A power tool which drives a tool bit in a longitudinal direction of the tool bit and performs an operation, comprising:

a motor which has an output shaft being parallel to the longitudinal direction of the tool bit, a driving mechanism which is connected to the output shaft and driven by the motor, a main body which houses the motor and the driving mechanism, a main handle which is movable with respect to the main body, a guide element which guides the main handle such that the main handle moves in the longitudinal direction of the tool bit with respect to the main body, and a biasing member which is arranged between the main body and the main handle and is preloaded with a biasing force that biases the main body and the main handle away from one another in the longitudinal direction of the tool bit even in an initial state, wherein the main handle moves against the main body in a state that the main handle is biased by the biasing member, and transmission of vibration generated during the operation from the main body to the main handle is prevented.

2. The power tool according to claim 1, wherein a periphery of the motor is formed cylindrically, and the guide element is arranged outside the motor in a radial direction of the motor.

3. The power tool according to claim 1, wherein the guide element comprises a pair of guide element components, and a plurality of guide elements are arranged at respective positions, which are different from one another in a circumference direction around the longitudinal direction of the tool bit.

4. The power tool according to claim 3, wherein the main handle includes a grip which extends in a direction crossing the longitudinal direction of the tool bit, and wherein the plurality of the guide elements are symmetrically arranged with respect to a plane which includes both of a longitudinal line of the tool bit and a extending line of the grip.

5. The power tool according to claim 3, wherein a pair of the guide element components comprises a metallic guide member arranged on one member among the main body and the main handle and a resin guide member arranged on the other member among the main body and the main handle.

6. The power tool according to claim 3, wherein the pair of the guide element components is formed by a projection which extends in the longitudinal direction of the tool bit and is arranged on one member among the main body and the main handle and a recess which extends in the longitudinal direction of the tool bit and is arranged on the other member among the main body and the main handle, and wherein the main handle is configured to be moved with respect to the main body in a state that the projection and the recess are engaged and slid to each other, and the main handle is guided against the main body.

7. A power tool according to claim 1, wherein the guide element includes a movement amount defining part which defines amount of movement of the main handle with respect to the main body in the longitudinal direction of the tool bit.

8. The power tool according to claim 1, wherein the biasing member comprises a plurality of biasing elements which are arranged at respective positions being different from one another in a circumference direction around the longitudinal direction of the tool bit.

9. The power tool according to claim 1, further comprising a sealing member which seals a gap between the main handle and the main body.

10. A power tool which drives a tool bit in a longitudinal direction of the tool bit and performs an operation, comprising:

a motor which has an output shaft being parallel to the longitudinal direction of the tool bit, a driving mechanism which is connected to the output shaft and driven by the motor, a main body which houses the motor and the driving mechanism, a main handle which is movable with respect to the main body, a guide element which guides the main handle such that the main handle moves in the longitudinal direction of the tool bit with respect to the main body, and a biasing member which is arranged between the main body and the main handle and biases the main body and the main handle in the longitudinal direction of the tool bit even in an initial state, wherein the main handle moves against the main body in a state that the main handle is biased by the biasing member, and transmission of vibration generated during the operation from the main body to the main handle is prevented, wherein the main handle includes a grip portion which is held by a user and an auxiliary handle attachable portion to which an auxiliary handle is attached, and wherein the grip portion and the auxiliary handle attachable portion are configured to move integrally in the longitudinal direction of the tool bit with respect to the main body.

11. The power tool according to claim 10, further comprising a guide portion which guides the auxiliary handle attachable portion against the main body.

12. The power tool according to claim 10, wherein the auxiliary handle attachable portion includes a ring portion which has an outer periphery to which the auxiliary handle is attached, the ring portion being configured to surround a part of the main body.

13. The power tool according to claim 10, wherein the main handle includes a connecting portion which fixedly connects the grip portion and the auxiliary handle attachable portion, and wherein the auxiliary handle attachable portion is arranged closer to the tool bit than the main handle in the longitudinal direction of the tool bit, and the grip portion is arranged opposite to the tool bit with respect to the auxiliary handle attachable portion in the longitudinal direction of the tool bit.

14. The power tool according to claim 13, wherein the main body includes a housing member which houses the motor and the driving mechanism, and wherein the auxiliary handle attachable portion includes a contact portion which is configured to contact with the housing member and the contact portion defines amount of movement of the main handle far from the tool bit in the longitudinal direction of the tool bit by contacting with the housing member.

* * * * *